US006698399B1

(12) United States Patent
Grabert

(10) Patent No.: US 6,698,399 B1
(45) Date of Patent: Mar. 2, 2004

(54) RADIAL PISTON PUMP FOR HIGH-PRESSURE FUEL SUPPLY

(75) Inventor: Peter Grabert, Modugno (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/600,396

(22) PCT Filed: Nov. 25, 1998

(86) PCT No.: PCT/DE98/03467

§ 371 (c)(1),
(2), (4) Date: Aug. 25, 2000

(87) PCT Pub. No.: WO99/36698

PCT Pub. Date: Jul. 22, 1999

(30) Foreign Application Priority Data

Jan. 16, 1998 (DE) ..... 198 01 353

(51) Int. Cl.[7] ..... F02M 37/04
(52) U.S. Cl. ..... 123/456; 123/495
(58) Field of Search ..... 123/495, 456, 123/446, 450; 417/273, 571

(56) References Cited

U.S. PATENT DOCUMENTS 3,306,211 A * 2/1967 Kunzler ..... 103/37
5,033,940 A * 7/1991 Baumann ..... 417/273
5,035,221 A * 7/1991 Martin ..... 123/451
5,354,183 A * 10/1994 Eisenbacher et al. ..... 417/366
5,358,383 A * 10/1994 Eisenbacher et al. ..... 417/569
5,364,234 A * 11/1994 Eickmann ..... 417/273
5,571,243 A * 11/1996 Arnold et al. ..... 123/198 DB
5,865,087 A * 2/1999 Olson ..... 91/497
5,876,186 A * 3/1999 Stiefel ..... 417/273

FOREIGN PATENT DOCUMENTS

FR 2288884 * 5/1976

* cited by examiner

*Primary Examiner*—Carl S. Miller
(74) *Attorney, Agent, or Firm*—Ronald E. Greigg

(57) ABSTRACT

The invention relates to a radial piston pump for high-pressure fuel supply, having a drive shaft supported in a pump housing. A plurality of pistons are disposed radially with respect to the drive shaft in a respective cylinder chamber; the pump housing includes a housing base body, in which the drive shaft is supported, and one housing head for each piston. The housing head has a through opening that extends radially to the drive shaft and a bush that serves to receive the piston is shrink-fitted into the through opening bush.

21 Claims, 1 Drawing Sheet

RADIAL PISTON PUMP FOR HIGH-PRESSURE FUEL SUPPLY

PRIOR ART

The invention relates to a radial piston pump for high-pressure fuel supply in fuel injection systems of internal combustion engines, in particular in a common rail injection system. The system includes a drive shaft, which is supported in a pump housing and is embodied eccentrically or has camlike protrusions in the circumferential direction. A plurality of pistons, disposed radially relative to the drive shaft in a respective cylinder chamber are movable back and forth in the respective cylinder chamber by rotation of the drive shaft. Check valves on the intake side and on the high-pressure side, and the pump housing includes a housing base body. The drive shaft is supported in the housing and one housing head for each piston is equipped with a fuel delivery opening and a fuel removal opening.

In one such radial piston pump, braced on the inside, the housing heads are braced against the housing base body and sealed by a number of elastomeric sealing elements. This leads to an undefined arrangement of the components of the pump.

It is therefore an object of the invention to furnish a radial piston pump that is proof against high pressure up to 1600 bar and in which the components subjected to high pressure and their sealing points are decoupled from one another and in the installed state are statically defined elastically.

A radial piston pump for high-pressure fuel supply in fuel injection systems of internal combustion engines including a common rail injection system, has a drive shaft, which is supported in a pump housing the drive shaft is embodied eccentrically or has camlike protrusions in the circumferential direction. A plurality of pistons are disposed radially relative to the drive shaft in a respective cylinder chamber and the pistons are movable back and forth in the respective cylinder chamber by rotation of the drive shaft. Check valves provided on the intake side and on the high-pressure side, and the pump housing includes a housing base body, in which the drive shaft is supported with one housing head for each piston. The housing head is equipped with a fuel delivery opening and a fuel removal opening. A problem is attained in that the housing head has a through opening, which extends radially to the drive shaft and into which a bush that serves to receive the piston is shrink-fitted. The bush is preferably a hardened bush that takes the form of a cylinder. By means of the shrink-fitted bush, a hard sealing of the cylinder chamber is achieved. The hard sealing assures a defined screw-fastening situation when the housing heads are secured to the housing base body. Furthermore, the number of single parts is reduced compared with a conventional radial piston pump. The inner jacket face of the bush which defines the cylinder chamber can advantageously be machined, for instance by grinding, in the shrink-fitted state. The housing head embodied according to the invention can furthermore be machined on a conventional honing machine, to improve the quality of the inner jacket face of the shrink-fitted bush. Thus even at peak pressures up to 1600 bar, perfect function of the bush is assured. Finally, the idle volume in the housing head is advantageously minimized by the bush.

One particular version of the invention is characterized in that the housing head rests with a flat bearing face against a flat bearing face of the housing base body. As a result, the housing head can rest in a statically precisely determined way with its flat bearing face on the housing base body. Hence in comparison with conventional pump housings, the interposition of any sealing elements whatever can be dispensed with.

A further special version of the invention is characterized in that the through opening has a portion of greater diameter for receiving the bush, and a portion of lesser diameter for receiving a closure element. The edge formed between the two portions forms a stop for the bush. This advantageously simplifies the installation of the bush.

A further special version of the invention is characterized in that the diameter of the portion having the lesser diameter is greater than the inside diameter of the bush. As a result, it is attained that the bush protrudes with its inner encompassing edge into the through opening and forms a stop for the closure element. This has the advantage that between the closure element and the bush, hard sealing can be achieved without the interposition of any sealing elements whatever.

A further special version of the invention is characterized in that a fuel delivery opening is provided in the closure element and has a seat for the intake-side check valve, the valve is mounted in the end of the bush remote from the drive shaft. The check valve on the intake side can for instance include a ball, which is pressed by a spring against the fuel delivery opening provided in the closure element. This has the advantage that no further single parts are needed for installing the check valve on the intake side.

A further special version of the invention is characterized in that the bush has a radial fuel removal opening, against the outer edge of which the check valve on the high-pressure side, which valve is mounted in the housing head, comes into contact. The check valve on the high-pressure side can, like the check valve on the intake side, include a ball that is pressed by a spring against the fuel removal opening provided in the bush. The sealing off of the check valve on the high-pressure side from the housing head can be achieved without the interposition of any sealing elements. The spring-supported embodiment of the check valve on the high-pressure side furthermore has the advantage that faster closing times can be attained. This increases the efficiency of the radial piston pump.

A further special version of the invention is characterized in that all the sealing points, subjected to high pressure, of metal components tightened against one another are formed without the interposition of elastomeric sealing elements. The securing of the housing head to the housing base body is achieved by screw connections, for instance. When the housing head is tightened against the housing base body, hard sealing is effected by the preferably metal bearing faces. This prevents leakage in the region of the radial piston pump. Furthermore, both the check valve on the intake side and the check valve on the high-pressure side are installed in the housing head in a hard-sealing manner.

The radial piston pump of the invention has the advantage in general of being more compact than conventional pumps and of comprising fewer single parts.

Further advantages, characteristics and details of the invention will become apparent from the dependent claims and the ensuing description, in which one exemplary embodiment is described in detail in conjunction with the drawing. The characteristics recited in the claims and mentioned in the description can each be essential to the invention individually or in arbitrary combination. One way of embodying the claimed invention is described below in detail in conjunction with the drawing.

DETAILED DESCRIPTION

Figure 1:
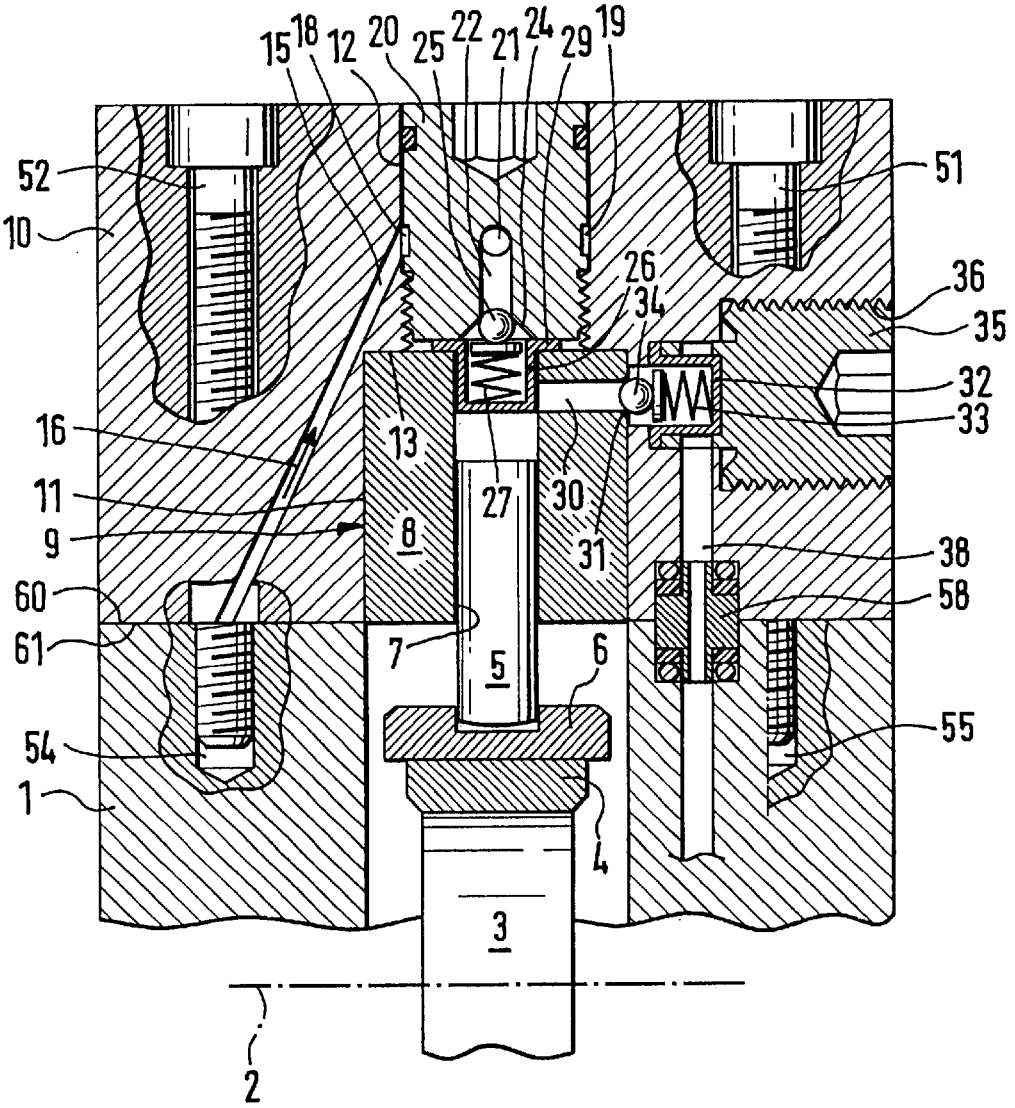
FIG. 1 shows a sectional view of a radial piston pump of the invention.

In the view in FIG. 1, only half of a radial piston pump of the invention is shown in fragmentary section. The radial piston pump of the invention is used in particular in common rail injection systems to supply fuel to diesel engines. The term "common rail" means the same as "common line" or "common distributor strip". In contrast to conventional high-pressure injection systems, in which the fuel is fed to the individual combustion chambers via separate lines, the injection nozzles in common rail injection systems are supplied from the common distributor strip.

The radial piston pump shown in FIG. 1 includes a housing base body 1, in which a drive shaft 2 is supported, of which only the center line is shown in dot-dashed lines, for the sake of simplicity. The drive shaft 2 is equipped with an eccentrically embodied shaft portion 3. A polygonal ring 4 is provided on the eccentric shaft portion 3, and the shaft portion 3 is rotatable relative to this ring. The ring 4 includes a plurality of flat faces, offset from one another, against each of which one piston 5 is braced with a plate 6. Instead of the polygonal ring 4, a cylindrical ring can also be used. The piston 5 is received in a cylinder chamber 7 in such a way that it can move back and forth radially relative to the drive shaft 2.

The cylinder chamber 7 is defined by the inner jacket face of a bush 8. The bush 8 is shrink-fitted into a bore 9 in a housing head 10. The housing head 10 has a flat bearing face 60, with which it rests against a flat bearing face 61 of the housing base body (1). The bore 9 extends through the housing head 10 and has a portion 11 with a greater diameter then a portion 12 with a lesser diameter. Between the portions 11 and 12 of the bore 9, an encompassing edge 13 is formed, which acts as a stop for the bush 8.

A plurality of fuel conduits are placed in the housing base body 1 and the housing head 10. Through the conduits, only a few of which are shown in FIG. 1, fuel is fed by a prefeed pump from a fuel tank into the cylinder chamber 7. In the cylinder chamber 7, the fuel is subjected to high pressure by the piston 5. The fuel subjected to high pressure passes through further conduits into a common rail, not shown.

As can be seen in FIG. 1, a fuel delivery conduit 15 extends through the housing head 10. Through the fuel delivery conduit, fuel is fed in the direction of the arrow 16 into an annular chamber 18. The annular chamber 18 is formed by the portion 12 of the bore 9 having the lesser diameter and by a circumferential groove 19, which is made in a closure element 20. In the closure element 20, there are a transverse bore 21 and a longitudinal bore 22, which communicate with one another.

On the end of the longitudinal bore 22 in the closure element 20, a countersunk feature is provided, which converges to a point at an angle of approximately 90°. The countersunk feature forms a seat 24 for a ball 25, which belongs to a check valve on the intake side. The ball 25 is pressed by a spring 27 against the seat 24. The check valve formed by the spring 27 and the ball 25 is secured in the bush 8 by a valve bush 26. The valve bush 26 has a flange 29, which serves as axial fixation.

The cylinder chamber 7 communicates with the fuel removal conduit 38 via a fuel removal bore 30 which is positioned radially in the bush 8. A check valve 32 is disposed between the fuel removal conduit 38 and the fuel removal bore 30. The check valve 32 includes a spring 33, which presses a ball 34 against a seat 31 that is provided in one end of the fuel removal bore 30. For the installation of the check valve 32, an installation bore 36 is provided in the housing head 10. A closure screw 35 which serves the purpose of sealing is screwing into the installation bore 36.

Securing the housing head 10 to the housing base body 1 is done by means of screws 51, 52, which extend through the housing head 10 and are screwed into threaded blind bores 54, 55 in the housing base body 1. For sealing off the fuel removal conduit 38, a high-pressure sealing element 58 is fitted between the housing head 10 and the housing base body 1.

Sealing off of the closure element 20 from the outside on the low-pressure side is attained by an O-ring.

The foregoing relates to a preferred exemplary embodiments of the invention, it being understood that other variants and embodiments thereof are possible within the spirit and scope of the invention, the latter being defined by the appended claims.

What is claimed is:

1. A radial piston pump for a high-pressure fuel supply in fuel injection systems of internal combustion engines, which comprises a common rail injection system, having a drive shaft (2), which is supported in a pump housing (1, 10) and is embodied eccentrically in the circumferential direction, a plurality of pistons (5), disposed radially relative to the drive shaft in a respective cylinder chamber (7), said pistons are moved back and forth in a respective cylinder chamber (7) by rotation of the drive shaft (2), check valves (26, 32) are provided on the intake side and on the high-pressure side, and the pump housing includes a housing base body (1), in which the drive shaft (2) is supported, and one housing head (10) for each piston (5), the housing head is equipped with a fuel delivery opening (15) and a fuel removal opening (38), the housing head (10) has a through opening (9), which extends radially to the drive shaft (2) and into which a bush (8) that serves to receive the piston (5) is shrink-fitted.

2. The radial piston pump of claim 1, in which each housing head (10) includes an engaging end which is flat over its entire extent and forms a flat bearing face (60), and the housing base body has an extent for each cylinder which is a continuous flat surface and forms a flat bearing face (61), wherein each flat bearing face (60) rests against a flat bearing face (61) of the housing base body (1).

3. The radial piston pump of claim 1, in which the through opening (9) has a portion (11) of greater diameter which receives the bush (8), and a portion (12) of lesser diameter which receives a closure element (20).

4. The radial piston pump of claim 2, in which the through opening (9) has a portion (11) of greater diameter which receives the bush (8), and a portion (12) of lesser diameter which receives a closure element (20).

5. The radial piston pump of claim 3, in which the diameter of the portion (12) having the lesser diameter is greater than the inside diameter of the bush (8).

6. The radial piston pump of claim 4, in which the diameter of the portion (12) having the lesser diameter is greater than the inside diameter of the bush (8).

7. The radial piston pump of claim 3, in which a fuel delivery opening (22) is provided in the closure element (20) and has a seat (24) for the intake-side check valve (25, 26, 27), and the valve is mounted in an end of the bush (8) remote from the drive shaft (2).

8. The radial piston pump of claim 4, in which a fuel delivery opening (22) is provided in the closure element (20) and has a seat (24) for the intake-side check valve (25, 26, 27), and the valve is mounted in an end of the bush (8) remote from the drive shaft (2).

9. The radial piston pump of claim 5, in which a fuel delivery opening (22) is provided in the closure element (20)

and has a seat (24) for the intake-side check valve (25, 26, 27), and the valve is mounted in an end of the bush (8) remote from the drive shaft (2).

10. The radial piston pump of claim 6, in which a fuel delivery opening (22) is provided in the closure element (20) and has a seat (24) for the intake-side check valve (25, 26, 27), and the valve is mounted in an end of the bush (8) remote from the drive shaft (2).

11. The radial piston pump of claim 1, in which the bush (8) has a radial fuel removal opening (30), against the outer edge of which the check valve (34) on the high-pressure side mounted in the housing head (10), comes into contact.

12. The radial piston pump of claim 2, in which the bush (8) has a radial fuel removal opening (30), against the outer edge of which the check valve (34) on the high-pressure side mounted in the housing head (10), comes into contact.

13. The radial piston pump of claim 3, in which the bush (8) has a radial fuel removal opening (30), against the outer edge of which the check valve (34) on the high-pressure side mounted in the housing head (10), comes into contact.

14. The radial piston pump of claim 5, in which the bush (8) has a radial fuel removal opening (30), against the outer edge of which the check valve (34) on the high-pressure side mounted in the housing head (10), comes into contact.

15. The radial piston pump of claim 7, in which the bush (8) has a radial fuel removal opening (30), against the outer edge of which the check valve (34) on the high-pressure side mounted in the housing head (10) comes into contact.

16. The radial piston pump of claim 1, in which all the sealing points, subjected to high pressure, of metal components tightened against one another are formed, without the interposition of elastomeric sealing elements.

17. The radial piston pump of claim 2, in which all the sealing points, subjected to high pressure, of metal components tightened against one another are formed without the interposition of elastomeric sealing elements.

18. The radial piston pump of claim 3, in which all the sealing points, subjected to high pressure, of metal components tightened against one another are formed without the interposition of elastomeric sealing elements.

19. The radial piston pump of claim 5, in which all the sealing points, subjected to high pressure, of metal components tightened against one another are formed without the interposition of elastomeric sealing elements.

20. The radial piston pump of claim 7, in which all the sealing points, subjected to high pressure, of metal components tightened against one another are formed without the interposition of elastomeric sealing elements.

21. The radial piston pump of claim 11, in which all the sealing points, subjected to high pressure, of metal components tightened against one another are formed without the interposition of elastomeric sealing elements.

* * * * *